US005669240A

United States Patent [19]

Lima

[11] Patent Number: 5,669,240

[45] Date of Patent: Sep. 23, 1997

[54] RING WITH ROLLERS

[76] Inventor: Alejandro E. Lima, 4807 W. Flagler St., Miami, Fla. 33134

[21] Appl. No.: 763,576

[22] Filed: Dec. 10, 1996

Related U.S. Application Data

[63] Continuation-in-part of Ser. No. 512,207, Aug. 7, 1995, abandoned.

[51] Int. Cl.[6] ..... A44C 9/00

[52] U.S. Cl. ..... 63/15; 63/26; 63/31

[58] Field of Search ..... 63/26, 2, 15, 28, 63/31

[56] References Cited

U.S. PATENT DOCUMENTS

| | | | |
|---|---|---|---|
| 1,131,593 | 3/1915 | Basher | 63/26 |
| 2,057,484 | 10/1936 | Grant | 63/26 X |
| 2,140,396 | 12/1938 | Whitaker | 63/28 X |
| 3,898,869 | 8/1975 | Reneer | 63/26 X |
| 4,977,757 | 12/1990 | Mesica et al. . | |
| 5,323,300 | 6/1994 | McCrary | 63/26 X |
| 5,398,525 | 3/1995 | Kennedy | 63/26 X |

FOREIGN PATENT DOCUMENTS

| | | | |
|---|---|---|---|
| 363137 | 7/1920 | Germany | 63/31 |

*Primary Examiner*—Blair Johnson
*Attorney, Agent, or Firm*—J. Sanchelima

[57] ABSTRACT

A device for enhancing the appearance of jewelry stones mounted to one of more rollers rotatably mounted within a protective housing. A phosphorescent member is cooperatively mounted within the housing to provide of source of light when lighting conditions are poor or non-existent. The rollers are removably mounted to the housing so that a user can readily remove them and combine different rollers.

6 Claims, 2 Drawing Sheets

RING WITH ROLLERS

OTHER RELATED APPLICATION

The present application is a continuation-in-part of U.S. patent application with Ser. No. 08/512,207 filed on Aug. 7, 1995, abandoned, which is hereby incorporated by reference.

BACKGROUND OF THE INVENTION

1. Field of the Invention

The present invention relates to jewelry, and more particularly, to a device that through moving parts enhances the brilliance and reflective characteristics of precious stones.

2. Description of the Related Art

Applicant believes that the closest reference corresponds to U.S. Pat. No. 4,977,757 issued to Mesica et al. in 1990. However, it differs from the present invention because Mesica's patent discloses a ring with different ornamental elements assembled forming a roller and mounted to the uppermost portion of a ring by two spindle elements 22 and 24, where these spindle elements have to be mounted from outside through openings 18 and 20. The present invention discloses a device that includes rollers removably mounted to the exposed portion of a jewelry piece, such as a ring, bracelet, cufflinks. A spring-pin permits the roller to be inserted within a protective housing. Also, Mesica's patent does not teach a phosphorescent element mounted below the roller as the present invention does, thereby bringing an additional brightness to the precious stones rigidly mounted to the outer surfaces of the rollers. In addition to, the present invention discloses a translucent cover element that is mounted to the top of the ring covering and protecting the precious stones.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device for enhancing the brightness and glamour.

It is another object of this invention to provide a device that has removable rollers permitting a user to selectively change the rollers impregnated with precious stones.

It is another object of this invention to provide a device that includes a phosphorescent element mounted below the rollers providing illumination to the stones for subsequent reflection.

It is still another object of the present invention to provide a device that includes a translucent cover element covering and protecting the valuable stones mounted on the rollers.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
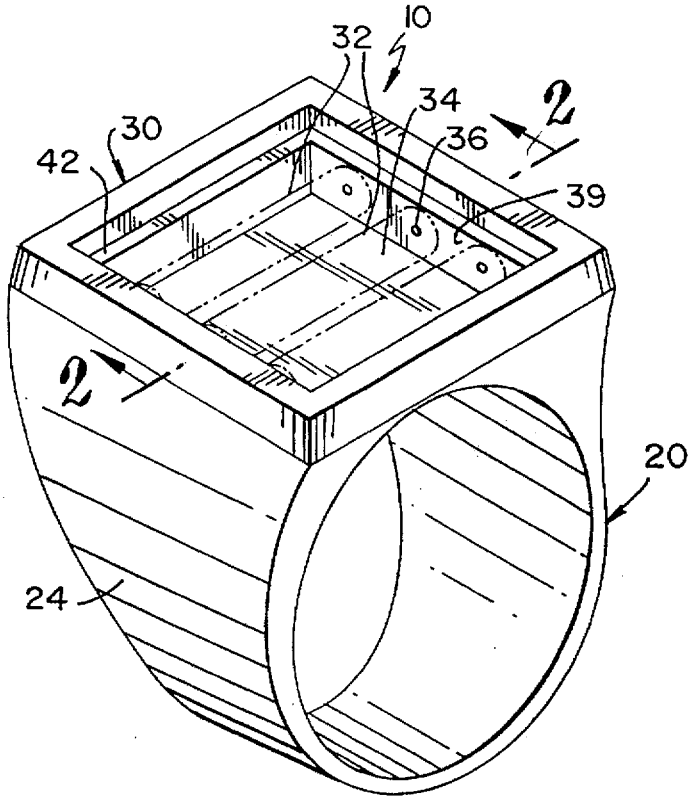
FIG. 1 is an isometric view from the top of the present invention, showing the rollers in phantom within the protective housing.

Referring now to the drawings, where the present invention is generally referred to with numeral 10, it can be observed that it basically includes protective housing assembly 30 with rollers 32 removably and rotatable mounted to jewelry member 20.

Figure 2:
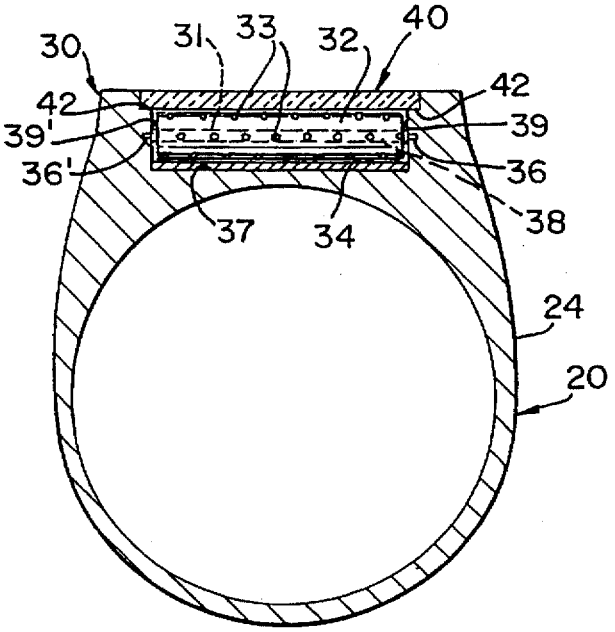
FIG. 2 is an elevational cross sectional view of this invention, taken along line 2—2 in the previous figure.
Figure 3:
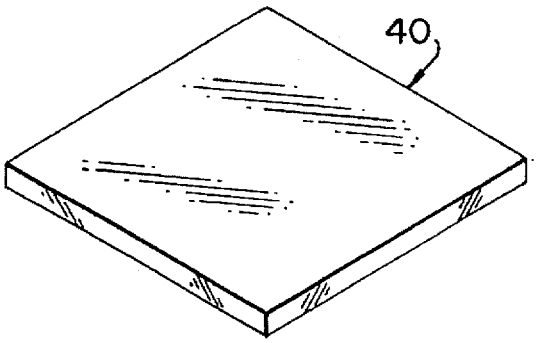
FIG. 3 is an isometric view of a cover plate that is mounted to the top of the ring previously shown in FIG. 2.
Figure 3A:
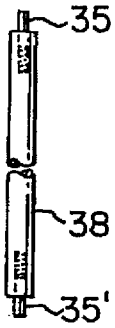
FIG. 3A is a top view of a spring-pin.
Figure 3B:
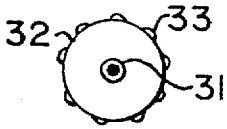
FIG. 3B is an elevational side view of a roller.
Figure 4:
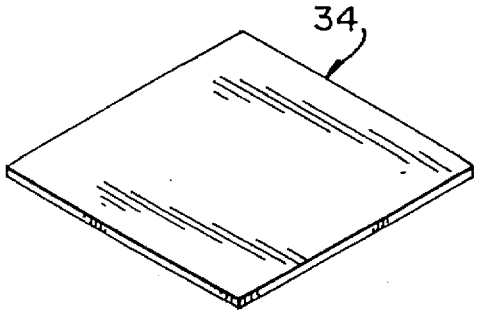
FIG. 4 is an isometric view of a phosphorescent element that is mounted below the rollers.

As shown in FIGS. 1 and 2, assembly 30 is located at the uppermost portion of member 20. Member 20 has outer surface 24 on which, and preferably in a exposed location, assembly 30 is mounted. Assembly 30 includes a rectangular frame with lateral walls 39; 39'; 39" and 39"". Assembly 30, in the preferred embodiment, houses rollers 32 and phosphorescent element 34. Rollers 32 are removably and rotatably mounted within protective housing assembly 30 by pins 38. Pin 38 is spring biased with its ends 35 and 35' housed within holes 36 and 36' located in lateral walls 39 and 39' of assembly 30. Pin 38 is passed through centrally disposed opening 31 along the length of roller 32. Rollers 32 have stones 33 impregnated in their outer surfaces. A user can change rollers 32 and replace with others by just compressing pins 38, similar to what is done with the bands of wrist watches. Ends 35 and 35' of pins 38, in the preferred embodiment, are mounted within holes 36 and 36'. Rollers 32 rotate freely over pins 38.

The present invention discloses phosphorescent element 34 that is mounted over wall 37 of assembly 30 and below rollers 32. It's purpose is to provide a luminous source that is more noticeable during low light conditions. Plate 34, in the preferred embodiment, includes a phosphorescent film applied over its exposed surface. The phosphorescent light coming from plate 34 and the free rotation of rollers 32 cause the former to be randomly reflected by the surfaces of the precious stones.

Cover member 40, in the preferred embodiment, is made out of a transparent or translucent material and is designed to cover assembly 30 and its contents from external forces and the environment. Cover plate 40 is removably mounted to the peripheral edge of assembly 30 on step 42 covering rollers 32, as best seen in FIG. 2. Different letters and/or characters can be engraved on cover plate 40 and they also can be selectively changed by a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for enhancing the appearance of jewelry stones, comprising:

A) housing means including a frame and a wall mounted thereon to define a space;

B) at least one roller means rotatably mounted within said space and said roller means includes an outer surface on which a plurality of stones are mounted; and C) a phosphorescent element positioned on said wall.

2. The device set forth in claim 1 further including:

D) transparent cover means mounted over said frame, opposite to said wall, protecting said space from the elements and extraneous objects.

3. The device set forth in claim 2 wherein said cover means includes designs.

4. The device set forth in claim 3 wherein said cover means is translucent.

5. The device set forth in claim 4 wherein said roller means is removably mounted within said space.

6. The device set forth in claim 5 wherein said roller means includes at least one roller member having a longitudinally extending centrally disposed opening and a spring biased pin removably mounted to said housing means and said roller member being rotatably mounted to said pin.

* * * * *